US008125129B2

(12) United States Patent
Maurer et al.

(10) Patent No.: US 8,125,129 B2
(45) Date of Patent: Feb. 28, 2012

(54) WORKING ELECTRODE FOR AN ELECTRODYNAMIC FRAGMENTING INSTALLATION

(75) Inventors: Daniel Maurer, Langenthal (CH); Reinhard Muller-Siebert, Bern (CH)

(73) Assignee: Selfrag AG, Kerzers (CH)

( * ) Notice: Subject to any disclaimer, the term of this patent is extended or adjusted under 35 U.S.C. 154(b) by 405 days.

(21) Appl. No.: 12/278,750

(22) PCT Filed: Feb. 15, 2006

(86) PCT No.: PCT/CH2006/000100
§ 371 (c)(1),
(2), (4) Date: Nov. 19, 2008

(87) PCT Pub. No.: WO2007/093063
PCT Pub. Date: Aug. 23, 2007

(65) Prior Publication Data
US 2009/0153009 A1 Jun. 18, 2009

(51) Int. Cl.
*H01T 13/20* (2006.01)

(52) U.S. Cl. ..... 313/141; 241/1

(58) Field of Classification Search ..... 313/118–145; 241/1, 301
See application file for complete search history.

(56) References Cited

U.S. PATENT DOCUMENTS

| | | | |
|---|---|---|---|
| 4,458,153 | A | 7/1984 | Wesley |
| 5,420,473 | A | 5/1995 | Thomas |
| 2005/0150688 | A1 | 7/2005 | MacGregor et al. |

FOREIGN PATENT DOCUMENTS

| | | |
|---|---|---|
| DE | 3844419 A1 | 7/1989 |
| JP | 2003-1137 | 1/2003 |
| SU | 1 781 892 | 8/1996 |
| SU | 1 790 069 | 8/1996 |

OTHER PUBLICATIONS

"Anchor Bolts," *Koenig Verbindungstechnik AG*, p. 16.1 (2001) Dietikon, Switzerland.
International Search Report for PCT/CH2006/000100 from the European Patent Office, dated Oct. 25, 2006.

*Primary Examiner* — Toan Ton
*Assistant Examiner* — Andrew Coughlin
(74) *Attorney, Agent, or Firm* — Marshall, Gerstein & Borun LLP

(57) ABSTRACT

The invention relates to working electrode for an electrodynamic fragmenting installation. The working electrode comprises an insulator (1) with a central conductor (2), which axially passes through the insulator (1) and carries at its working end an electrode tip (3) which is formed by an exchangeable changing part (4) and adjoins a stop area (6) of the central conductor (2) with a contact area (5) under axial compressive prestress.
The invention makes it possible to provide working electrodes for electrodynamic fragmenting installations in which the electrode tips can be exchanged in a simple manner and which can be operated practically without maintenance over a long period of time even in case of great pressure pulsations.

43 Claims, 8 Drawing Sheets

WORKING ELECTRODE FOR AN ELECTRODYNAMIC FRAGMENTING INSTALLATION

TECHNICAL FIELD

The invention concerns a working electrode for an electrodynamic fragmenting installation, changing parts for such a working electrode as well as a use of the working electrode according to the preambles of the independent claims.

PRIOR ART

In the electrodynamic fragmentation of material, like e.g. concrete, between a working electrode, which is charged with high voltage pulses, and a base electrode, which typically is at zero-potential, high voltage breakdowns are generated through the material that shall be fragmented, whereby a fragmentation of said material is achieved. At each high voltage breakdown, there also occurs a slight material removal at the tip of the working electrode, so that after a certain operating time it is worn-out and needs replacement. Replacement of the electrode might also be necessary upon a change of the material that is to be fragmented by the installation, in order to avoid a contamination of the final product with an undesirable electrode material. In both cases it is, at the electrodynamic fragmenting installations known today, necessary to exchange the entire working electrode including insulator, which is a cost-intensive and time consuming undertaking, last but not least because the working electrodes are, at their connecting side, typically coupled to a system filled with insulating oil. Therefrom results as a further disadvantage that it is uneconomic to use up not completely exhausted electrodes, since the installation work is huge compared to the residual usage time.

DISCLOSURE OF THE INVENTION

Thus, it is the objective to provide a working electrode which does not have the disadvantages of the prior art or at least partially avoids them.

This objective is achieved by the working electrode and the changing parts for such a working electrode according to the independent claims.

Accordingly, a first aspect of the invention relates to a working electrode for an electrodynamic fragmenting installation having an exchangeable electrode tip. The working electrode comprises an insulator, e.g. made of plastics or of a ceramic material, with a central conductor made of a material which is electrically well conductive, preferably of a metallic material, e.g. of aluminum, copper or stainless steel, which axially penetrates the insulator. At one end, the central conductor is adapted for connection to a high voltage generator in order to charge the working electrode with high voltage pulses. At its other end, the so called working end, which in operation is immersed into the working area that is filled with process fluid, e.g. water, and the material to be fragmented, the central conductor carries an electrode tip, which in operation forms the starting point for the high voltage breakdowns. The electrode tip is formed by an exchangeable changing part that is of one-piece design or is formed by several pieces.

Such working electrodes provide the advantage that upon wear of the electrode or when the material to be fragmented changes, merely the tip of the electrode needs to be exchanged, and e.g. an opening of an oil-filled high voltage system in order to exchange the entire working electrode becomes redundant. By means of this, the maintenance related downtimes and operating costs of electrodynamic fragmenting installations can considerably be reduced.

In a preferred embodiment of the working electrode, the changing part comprises a contact area which serves as axial stop of the changing part at the central conductor and at the working end of the central conductor abuts under axial compressive prestress against a stop area of the central conductor. The contact area of the changing part and/or the stop area of the central conductor can e.g. be designed as edgeless stop areas with mere radial extent or also as cone shaped surfaces having a radial and axial extent. Such working electrodes are especially reliable in operation.

In a further preferred embodiment of the working electrode, the changing part is, at the end facing away from the electrode tip, connected with the central conductor via a first threaded connection, for fastening the changing part at the central conductor and for generating the compressive prestress between the contact area and the stop area. By means of this, an uncomplicated exchangeability and a safe fastening of the changing part results.

In this embodiment it is preferred that the exchangeable changing part between the first threaded connection and the contact area comprises an elongation area, preferably with a length of at least two times, more preferably of at least four times the diameter of the first threaded connection, which according to the principle of an anti-fatigue bolt through elastic elongation is under tensile prestress and thereby generates the compressive prestress between the contact area and the stop area. Preferably, the elongation area of the changing part is designed as anti-fatigue shaft or as anti-fatigue sleeve, wherein in the first mentioned case it preferably forms the outer thread at one end and in the latter case preferably the inner thread of the first threaded connection.

Alternatively or additionally it is preferred that the central conductor comprises, between the first threaded connection and the stop area, an elongation area, preferably with a length of at least two times, more preferably of at least four times the diameter of the first threaded connection, which according to the principle of an anti-fatigue bolt through elastic elongation is under a tensile prestress and thereby generates the compressive prestress between the contact area and the stop area. Preferably, the elongation area of the central conductor is designed as anti-fatigue shaft or as anti-fatigue sleeve, wherein in the first mentioned case it preferably forms at one end the outer thread and in the latter case preferably the inner thread of the first threaded connection.

Such working electrodes having elongation areas especially provided by their design are robust and can be operated even at strong pressure pulsations in the working area over a long time without any maintenance, since between the central conductor and the exchangeable changing part merely pulsating forces occur, but no alternating forces.

In a further preferred embodiment, the changing part is designed as one piece, in another it is formed by several parts, which in the first case provides the advantage of a simple, robust construction and in the latter case provides greater freedom for designing the changing part.

In the above case when the changing parts are formed by several parts, it is preferred that the contact area of the changing part is formed by a stop member that is designed preferably as screw nut, preferably as hexagonal nut or screw nut with frontal holes, which stop member together with a further part of the changing part, which further part forms the outer thread or the inner thread of the first threaded connection and is made in one piece together with the electrode tip, forms a second threaded connection. By this it becomes possible to first fasten the electrode tip or the part of the changing part forming said tip, respectively, by means of the first threaded connection to the central conductor and then to generate, by means of the stop member and the second threaded connection, the compressive prestress between the contact area and the stop area. This is particular of advantage in cases where embodiments having long elongation areas between the first and the second threaded connection are used, since in these cases a pre-stressing is possible also without introduction of substantial torsional forces in the elongation area, so that the elongation area can optimally be designed for its function.

In still a further preferred embodiment of the working electrode with a first threaded connection according to the claims, the changing part comprises between the electrode tip and the contact area, e.g. shortly before the electrode tip, an area having a not rotationally symmetrical cross section, so that its contour can be engaged in a positive manner with a screwing tool for the screwing and unscrewing of the changing part. In the before mentioned embodiment, it is by this furthermore possible to secure the body of the changing part against turning during tightening of the second threaded connection, by means of which a introduction of torsional forces into the elongation area of this embodiment can completely be obviated.

By advantage, the changing part, in order to achieve this, comprises, in the area between the electrode tip and the contact area, at least two parallel surfaces. Such surfaces are easy to produce and permit the turning or securing against turning of the changing part by means of commercially available flat spanners.

In another preferred embodiment of the working electrode, the changing part comprises in an area adjacent to its contact area at its outer circumference a circumferential, radial bead. In embodiments in which the stop member is designed e.g. as a screw nut which provides the contact area according to the claims, it is preferred that this stop member at its end facing towards the central conductor comprises at its outer circumference a circumferential, radial bead.

In both cases, the radial, circumferential bead serves for the field relief in the area where the central conductor protrudes out of the insulator, by means of which the operating life of the insulator and of the central conductor can considerably be increased.

In another preferred embodiment of the working electrode the changing part is in a non-positive manner by means of clamping mounted in a frontal opening in the working end of the central conductor, which preferably is achieved in that the changing part comprises a preferably cylindrical expansion sleeve and a spacing body that at least partially is arranged inside the expansion sleeve, by means of which the expansion sleeve can be expanded in an area in such a manner that it is radially pressed against the wall of the frontal opening and thereby is axially non-displaceable clamped inside the opening. By this, a save fastening of the changing part at the central conductor can be achieved in an easy way.

In that case it is of advantage when the spacing body is connected with a driving member for an axial displacing of same relative to the expansion sleeve in order to effect a radial expanding of the expansion sleeve, which driving member protrudes out of the frontal opening at the working end of the central conductor and at it end facing away from the spacing body forms the electrode tip. By means of this it is possible to effect the clamping of the changing part in the central conductor in a simple way by exerting an axial force on the driving member. In case the spacing body and the driving member are formed together as one piece, which is preferred, a particular simple and robust construction results.

It also is preferred in this case that the spacing body comprises a preferably conical or pyramidal section for the radial expanding of the expansion sleeve or as a whole is designed as a truncated cone or a frustum of pyramid, since by this huge expanding forces can be generated in a controlled manner.

By advantage, the driving member comprises between the electrode tip and the spacing body an outer thread, by means of which an axial force can be exerted onto it for causing a displacement of the spacing body and a resulting radial expanding and clamping of the expansion sleeve in the opening in the central conductor. In this way, relative large displacement forces can be provided in a controlled manner.

If in the above case the spacing body is designed in such a manner that an axial displacement of same in direction towards the working end of the central conductor causes a radial expanding of the expansion sleeve, thus the driving member must transmit tensile forces for effecting the clamping of the changing part in the central conductor, it is of advantage when the outer thread of the driving member interacts for generating the axial displacement forces with a respective inner thread of an abutment member, which axially rests on the expansion sleeve. By this a simple construction with only few parts results.

Furthermore it is preferred in the before mentioned embodiment when the abutment member is a hexagonal nut or a screw nut with at least two frontal openings, which preferably at its outer circumference comprises a circumferential, radial bead which can serve as field relief.

By advantage, the driving member comprises in that case between the spacing body and the outer thread an elongation area preferrably designed as anti-fatigue shaft or as anti-fatigue sleeve, by advantage with a length of at least two times, preferably at least four times of the diameter of the outer thread.

Is the spacing body however designed in a manner that an axial displacement of the same in direction away from the working end of the central conductor causes a radial expanding of the expansion sleeve, thus the driving member must transmit compressive forces for effecting the clamping of the changing part in the central conductor, it is preferred that the outer thread of the driving member interacts with a respective inner thread of an abutment member, which axially is connected with the expansion sleeve for transmitting axial tensile forces between the abutment member and the expansion sleeve. If, in the above case, the abutment member is formed as one piece with the expansion sleeve, which is preferred, an as compact as possible construction with a minimum of parts results.

By advantage, the expansion sleeve in this case comprises, in the area between the abutment member and the area where it is radially expanded by the spacing body, an elongation area, which preferably has a length of at least two times, more preferably at least four times the diameter of the inner thread of the abutment member.

As has already been presented on the basis of some before mentioned preferred embodiments, by providing, on the part of the design, elongation areas for the transmission of the forces that are necessary for generating the compressive forces between parts of the exchangeable changing part and the central conductor, alternating forces between these parts can be avoided even at strong pressure pulsations in the working area, so that especially robust and over a long time maintenance free working electrodes can be made available.

Preferably, the driving member comprises, between electrode tip and spacing body, an area of non rotationally symmetrical cross-section, preferably at least two parallel surfaces, which can be engaged in a positive manner with a tool, like e.g. a flat spanner, in order to turn the driving member relative to the expansion sleeve and/or for temporarily securing of same against turning.

In still another preferred embodiment of the working electrode, a gasket is arranged between the changing part and the central conductor, preferably an O-ring, for preventing process fluid and dirt from entering into the fastening area between the changing part and the central conductor. In particular in embodiments, in which the changing part is connected with the central conductor via the before mentioned first threaded connection, a fouling and damaging of same can be avoided by means of this.

In still a further preferred embodiment of the working electrode, the central conductor comprises, in the area of its working side end where it protrudes out of the insulator, at its outer circumference a circumferential, radial bead.

In still a further preferred embodiment of the working electrode, the central conductor comprises, in the area where at its working end it protrudes out of the insulator, an area with a not rotationally symmetrical cross-section, preferably two parallel surfaces, for the positive interaction with a tool, like e.g. a flat spanner.

Alternatively or additionally it is preferred that the central conductor, at its working end sided face, comprises at least two frontal holes for the positive interaction with a face spanner.

Through these embodiments it becomes possible to secure the central conductor during assembly and/or disassembly of the changing part against a turning within the insulator, which at central conductors that are non-positively, e.g. by force fitting or by shrinking, fastened inside the insulator can lead to a loosening or destruction of the interconnection with the insulator.

In preferred embodiments of the working electrode the electrode tip has the shape of a spherical calotte or of a rotation paraboloid. Such shapes provide a locally defined breakdown initiation point, and at the same time a sound service life of the electrode tip.

A second aspect of the invention relates to a changing part for a working electrode according to the first aspect of the invention. The changing part comprises an elongate, electrically conductive base body, preferably made of a metal or a metal alloy, which at one end carries a first outer thread for fastening of same at a central conductor of a working electrode and at its other end an electrode tip. Between the electrode tip and the first outer thread there is arranged a second outer thread, which is intended for the screwing on of a stop member having a contact area for axial abutment against a stop area at the central conductor. Between the electrode tip and the second outer thread the base body comprises an area having a non rotationally symmetrical cross-section, so that in a rotational direction around its longitudinal axis it can be positively gripped with a suitable screwing tool, for the screwing and unscrewing, respectively, of the base body in the central conductor of the working electrode and for securing the same against turning during the tightening of a screw nut type stop member arranged on the second outer thread for generating a compressive prestress between the contact area of the stop member and the stop area of the central conductor. Preferably the base body, in order to make this possible, comprises, in the area between the electrode tip and the second thread, at least a pair of parallel surfaces, which can interact with a flat spanner of suitable size. Furthermore, the base body comprises between the first outer thread and the second outer thread an anti-fatigue shaft, preferably with an anti-fatigue shaft length of at least two times, preferably at least four times the diameter of the first outer thread.

In a preferred embodiment of the changing part it furthermore comprises, arranged at the second outer thread, a stop member with a contact area for axial abutment against a stop area of the central conductor, which preferably also comprises at least two parallel surfaces for the positive interaction with a flat spanner.

A third aspect of the invention relates to another changing part for a working electrode according to the first aspect of the invention. The changing part as well comprises an elongate electrically conductive, preferably metallic base body, which at one end carries an inner thread for fastening the changing part at a central conductor of a working electrode and at its other end ends in an electrode tip. Between the electrode tip and the inner thread there is arranged a stop shoulder for axial abutment against a stop area of the central conductor. Furthermore the base body comprises between the stop shoulder and the electrode tip an area having a non rotationally symmetrical cross section, so that in rotational direction around its longitudinal axis it can positively be driven by means of a suitable screwing tool, for screwing the base body in the receiving opening of the central conductor of the working electrode in order to fasten the changing part at the central conductor and to generate a compressive prestress between the contact area of the stop member and the stop area of the central conductor. For this, the base body preferably comprises, in the area between the electrode tip and the stop member, at least one pair of parallel surfaces, which by means of a flat spanner of a respective size can be engaged. Between the inner thread and the stop shoulder, the base body of the changing part is designed as anti-fatigue sleeve, preferably with an anti-fatigue sleeve length of at least two times, preferably at least four times the diameter of the inner thread.

In that case it is preferred that the changing part is of one-piece design.

Furthermore it is preferred that the stop shoulder is formed of a circumferential, radial bead of the changing part, which can serve as field relief.

A fourth aspect of the invention relates to a changing part for a working electrode according to the first aspect of the invention. The changing part comprises an expansion sleeve and a preferably conical or pyramidal spacing body, which is arranged at least partially inside the expansion sleeve and interacts therewith in such a manner that the expansion sleeve through an axial displacement of the spacing body relative to it can be radially expanded in an area, preferably in an end area of the expansion sleeve. In that case, the spacing body is preferably through material connection, like e.g. through one piece design or by soldering or welding, connected with a driving member for the displacement of the spacing body within the expansion sleeve, which driving member at its end facing away from the spacing body protrudes out of the expansion sleeve and at this end forms an electrode tip with the shape of a spherical calotte or of a rotation paraboloid. Between the electrode tip and the spacing body, the driving member comprises an outer thread, on which a preferably screw nut type abutment member with a respective inner thread is arranged. The abutment member axially rests at the expansion sleeve, so that a rotating of same relative to the driving member can effect an axial movement of the spacing body which is connected with the driving member in direction towards the electrode tip, which in turn causes an increasing expanding of the expansion sleeve.

In a preferred embodiment of the changing part, the abutment member is designed as a screw nut with frontal holes, preferably with at least two, more preferably with at least four frontal holes distributed with an equal indexing. In this case it is furthermore preferred that the screw nut with frontal holes at its outer circumference forms a circumferential radial bead, and more preferably, that it has substantially the form of a washer having rounded circumferential edges. By this, the abutment member can also serve as field relief.

In a further preferred embodiment of the changing part, the driving member comprises between the spacing body and the outer thread an elongation area which preferably is designed as anti-fatigue shaft or anti-fatigue sleeve, preferably with a length of at least two times, more preferably of at least four times the diameter of the outer thread.

A fifth aspect of the invention relates to a changing part for a working electrode according to the first aspect of the invention. The changing part comprises an expansion sleeve and an in particular conical or pyramidal spacing body for a radial expanding of the expansion sleeve upon an axial displacement of said spacing body relative to the expansion sleeve. In that case, the spacing body is, preferably by material connection, like e.g. through one piece design or through welding or soldering, connected with a driving member for a displacement of the spacing body inside the expansion sleeve. The driving member at its end facing away from the spacing body protrudes out of the expansion sleeve and at this end is designed as an electrode tip having the shape of a spherical calotte or of a rotation paraboloid. Between the electrode tip and the spacing body the driving member comprises an outer thread, which interacts with a respective inner thread of an abutment member. The abutment member is connected, preferably through one piece design, with the expansion sleeve, so that a transmission of axial tensile forces between the abutment member and the expansion sleeve is possible and through rotation of the driving member relative to the abutment member an axial movement of the spacing body in a direction pointing away from the electrode tip can be effectuated, which in turn leads to an increasing expanding of the expansion sleeve.

In a preferred embodiment of the changing part, the expansion sleeve comprises in the area between the abutment member and the area, where it is radially expanded by the spacing body, an elongation area, preferably with a length of at least two times, more preferably of at least four times the diameter of the inner thread of the abutment member. Typically, such elongation areas are identifiable in that they show a reduced cross-section in order to arrive at an as little rigid as possible elongation characteristic.

The changing parts according to the second, third, fourth and fifth aspect of the invention constitute preferred trade goods and allow for the construction of working electrodes in which the electrode tip can in a simple manner be exchanged, without disconnecting the electrode from the voltage supplying system.

A sixth aspect of the invention relates to the use of the working electrode according to the first aspect of the invention for the electrodynamic fragmentation of preferably poorly conductive materials like concrete or slag. In such uses, the advantages of the invention become particular clearly apparent.

BRIEF DESCRIPTION OF THE DRAWINGS

Further embodiments, advantages and applications of the invention become apparent from the depending claims and from the following description with reference to the drawings. Therein show:

MODES FOR CARRYING OUT THE INVENTION

Figure 1:
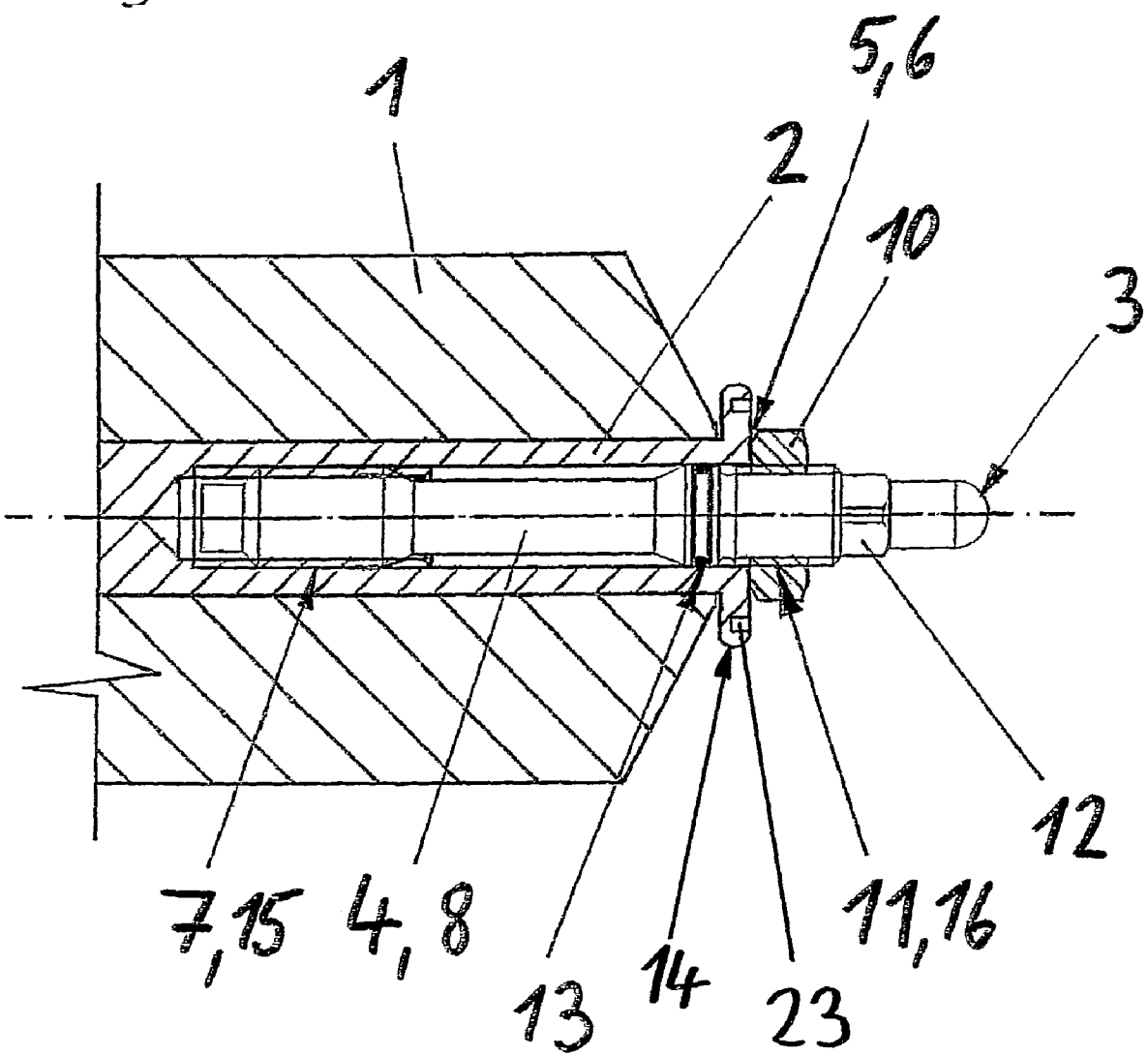
FIG. 1 a longitudinal section through the working end of a first working electrode according to the invention.

FIG. 1 shows the working end of a first working electrode according to the invention in a longitudinal section. As is visible here, the electrode comprises a cylindrical and towards the working end truncated cone shaped insulator 1 made of a thermoplastic synthetic material, in the present case polyethylene, with a central conductor 2 made of stainless steel arranged in its center, which is force fitted into the insulator 1 and thereby is secured therein in a play free manner. The central conductor 2 at its working end sided face comprises in the border area two equally distributed small frontal holes 23 as well as a larger central blind hole bore, which towards the working end, at which the central conductor 2 protrudes out of the insulator 1 thereby forming a circumferential radial bead 14, is opened and in the area of its closed end forms an inner thread. Arranged in the central bore of the central conductor 2 is a changing part 4 according to the claims, which by means of an end sided outer thread 15 is screwed into the inner thread of the central bore and thus under formation of a first threaded connection 7 according to the claims is affixed to the central conductor 2.

Figure 2:
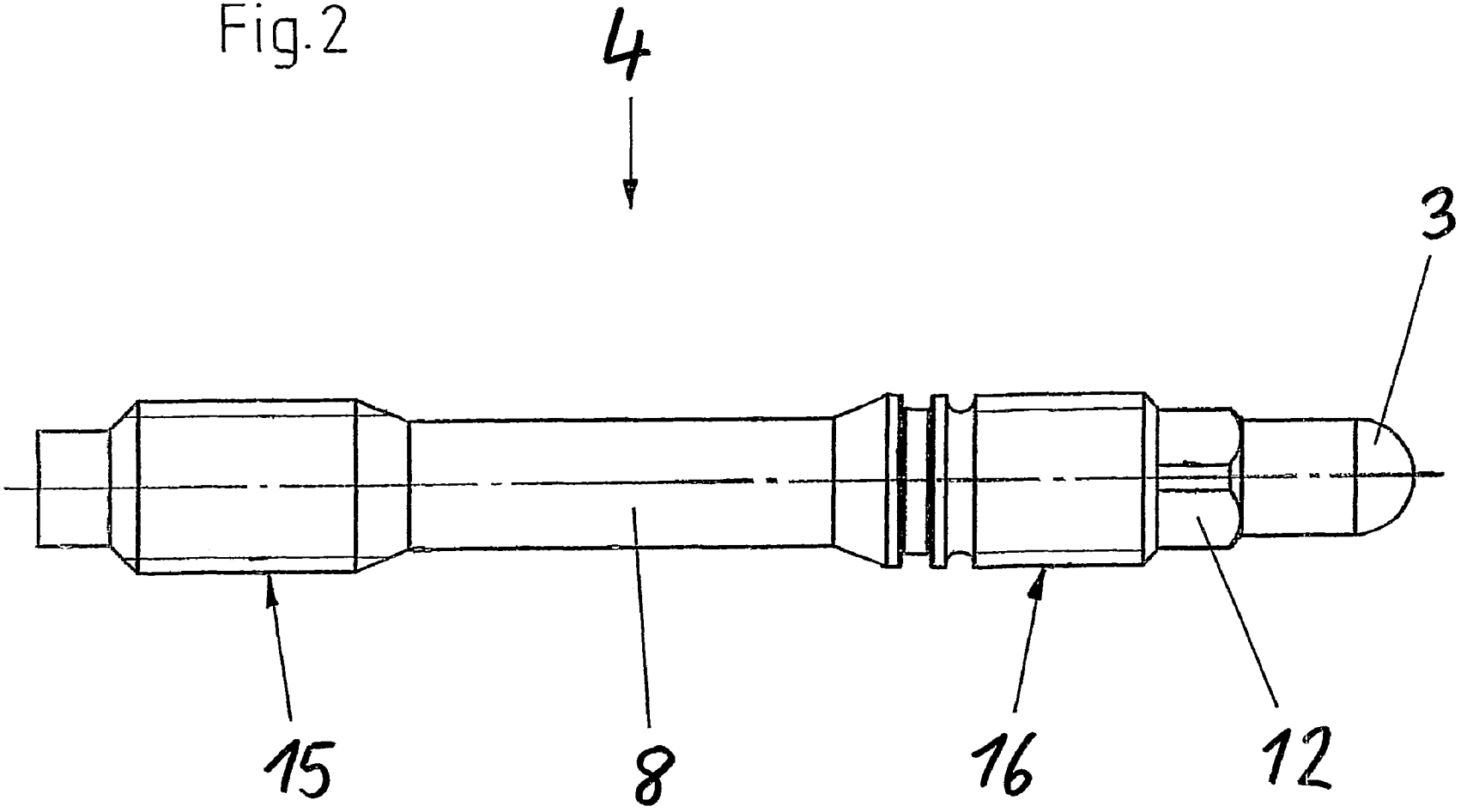
FIG. 2 a lateral view of the changing part according to the invention of the working electrode of FIG. 1.

As can be seen when additionally considering FIG. 2, which shows the changing part 4 according to the invention in a lateral view, the changing part 4 forms, at its other end, a hemispherical electrode tip 3, which during operation serves as starting point for the high voltage breakdowns. Between electrode tip 3 and the first threaded connection 7 the changing part 4 comprises a second outer thread 16, which carries a hexagonal nut 10 that serves as stop member 10 according to the claims, thereby forming a second threaded connection 11 according to the claims. In doing so, the screw nut 10 abuts with its face 5 showing away from the working end, which face forms the contact area 5 according to the claims, axially edgeless and under compressive prestress against the working sided front face 6 of the central conductor 2, which forms the stop area 6 according to the claims and fluently passes over into the bead 14. In order to ensure the existence of a compressive prestress between the contact area 5 and the stop area 6 at any time even at heavy pressure pulsations, the changing part 4 comprises in the area between the first thread 7 and the second thread 11 an elongation area designed as anti-fatigue shaft 8, which has a length of about three times the diameter of the first threaded connection 7. In order to prevent process liquid and dirt from entering into the central bore in the central conductor 2, between the anti-fatigue shaft 8 and the second threaded connection 11 there is arranged an O-ring 13 in a circumferential groove on the changing part 4, which seals the annulus shaped gap formed between the changing part 4 and the wall of the central bore. Furthermore the changing part 4 comprises in the area between the second threaded connection 11 and the electrode tip 3 four surfaces 12 that are arranged relative to each other in each case under an angle of 90°, which can interact with a flat spanner in order to screw and unscrew the changing part 4 into the central conductor 2 and out of same and/or to secure the changing part 4 against turning during the tightening of the second threaded connection 11.

In case it is desired to exchange at the shown working electrode the electrode tip 3, be it because said tip is worn out or be it because a tip of different material shall be used, first of all the central conductor 2 is secured against turning inside the insulator 1 by means of a face spanner that engages the two frontal holes 23 and, as the case may be, also the changing part 4 is secured against a turning inside the central conductor 2 by means of a flat spanner that engages the surfaces 12 and thereafter the screw nut 10 on the second outer thread 16 is untightened by means of a spanner. Subsequently, the changing part 4 with the aid of a flat spanner is screwed out of the central conductor 2. Thereafter, a new or different changing part 4 is screwed into the central bore of the central conductor 2 and subsequently the screw nut 10 of this changing part 4 is tightened with a specific torque in order to generate the compressive prestress between the contact area 5 and the stop area 6, whereby the anti-fatigue shaft 8 is elastically elongated under tensile stress. At the same time, the changing part 4 with a flat spanner at the surfaces 12 and the central conductor 2 by means of a face spanner engaging its two frontal holes 23 are secured against turning in order to avoid a torsion loading of the anti-fatigue shaft 8 and to avoid a turning of the central conductor 2 in the insulator 1. Preferably, the face spanner for securing the central conductor 2 against turning and the flat spanner for securing the changing part 4 against turning are formed by only one special tool, so that the assembly/disassembly is facilitated and a turning of the changing part 4 relative to the central conductor 2 during a tightening or untightening, respectively, of the screw nut 10 is precluded from the outset.

Figure 3:
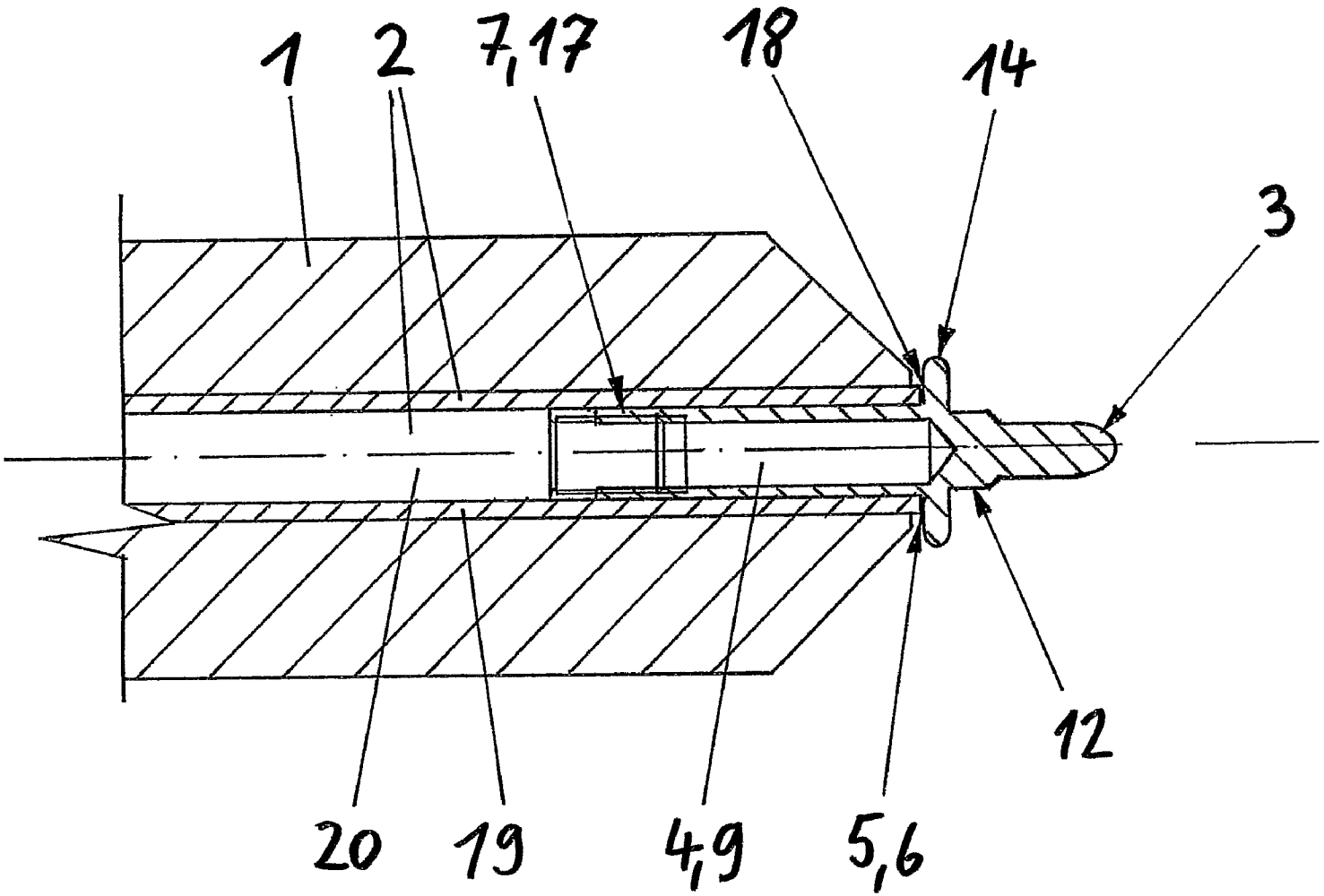
FIG. 3 a longitudinal section through the working end of a second working electrode according to the invention.

FIG. 3 shows the working end of a second working electrode according to the invention in a longitudinal section. As can be seen, the electrode in this case as well comprises a cylindrical and towards the working end truncated cone shaped insulator 1, in the center of which there is arranged a central conductor 2 formed by a press fitted cylinder sleeve 19 with a tension anchor 20 fastened inside the sleeve 19 which is having an outer thread. The cylinder sleeve 19 is opened towards the working end and receives inside this opening a changing part 4 according to the claims that is of one piece design, which is within the cylinder sleeve 19 by means of an end sided inner thread 17 formed by it bolted together with the outer thread of the tension anchor 20 and thereby fastened to the central conductor 2, while forming a first threaded connection 7 according to the claims. At its other end, the changing part 4 forms an electrode tip 3 with the shape of a rotation paraboloid. Between the electrode tip 3 and the inner thread 17 of the first threaded connection 7 the changing part 4 comprises a circumferential radial bead 14, which serves as field relief and constitutes a stop shoulder 18 according to the claims, which provides the contact area 5 according to the claims, by which the changing part 4 axially abuts under compressive prestress against the face 6 of the cylinder sleeve 19 of the central conductor 2 protruding out of the insulator 1, which face forms the stop area 6 according to the claims. In order to ensure the existence of a compressive prestress between the contact area 5 and the stop area 6 at any time even at heavy pressure pulsations, the changing part 4 comprises in the area between the first thread 7 and the stop shoulder 18 an elongation area designed as anti-fatigue sleeve 9, which has a length of about three times the diameter of the first threaded connection 7. In order to facilitate the screwing and unscrewing of the changing part 4 into the central conductor 2 and to permit a tightening of the first threaded connection 7 for generating the compressive prestress between the contact area 5 and the stop area 6, the changing part 4 comprises, in the area between the stop shoulder 18 and the electrode tip 3, two parallel surfaces 12, which can be engaged with a flat spanner.

In case it is desired to exchange at the working electrode shown in FIG. 3 the electrode tip 3, the changing part 4 is screwed out of the cylinder sleeve 19 of the central conductor 2 by catching the two surfaces 12 with a suitable flat spanner. Thereafter, a new or different changing part 4 is screwed into the central bore of the central conductor 2 and is tightened with a specific torque, so that via the threaded connection 7 between the changing part 4 and the tension anchor 20 of the central conductor 2 a desired compressive prestress between the contact area 5 and the stop area 6 is generated, in that the anti-fatigue sleeve 9 is elastically elongated under tensile stress.

Figure 4:
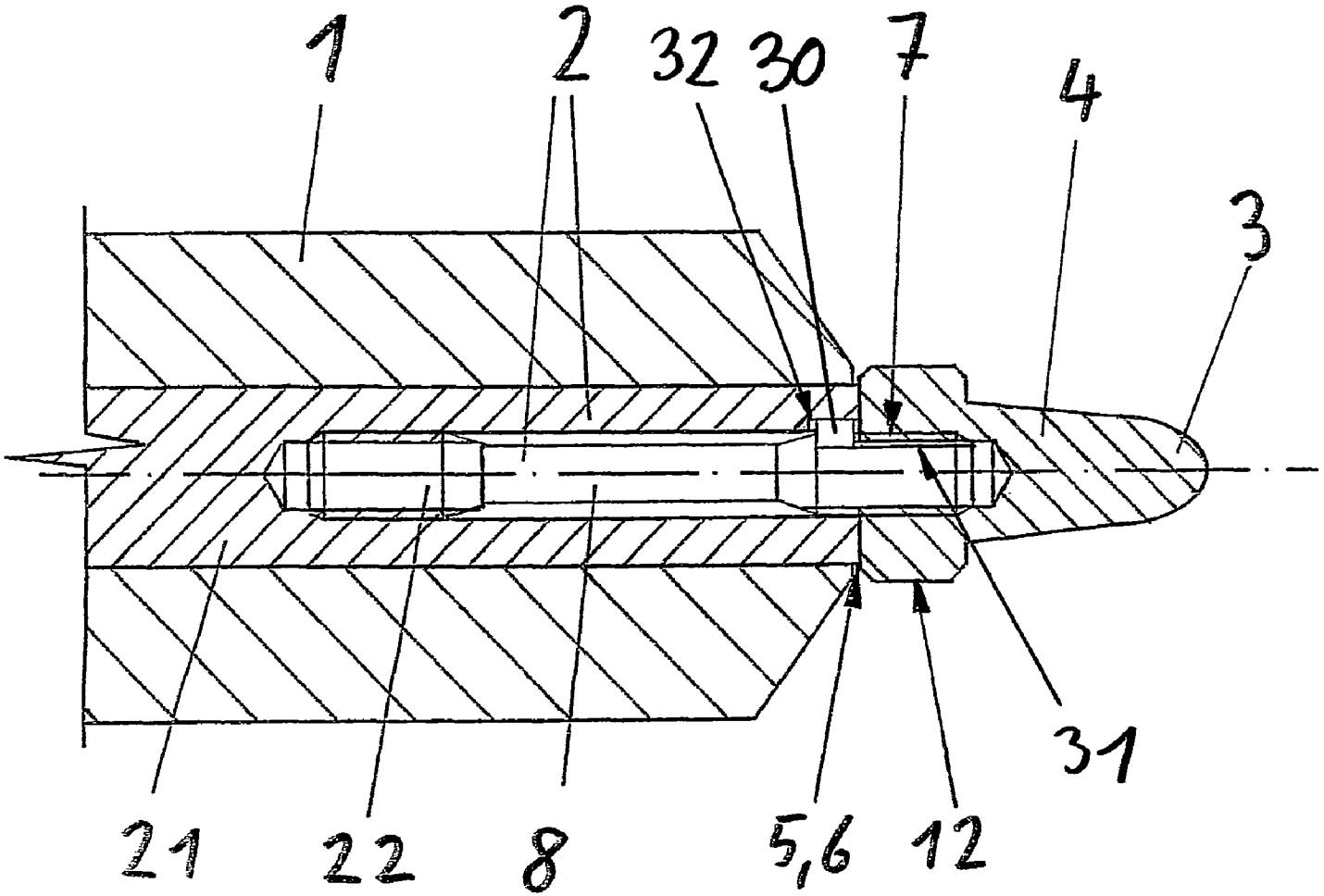
FIG. 4 a longitudinal section through the working end of a third working electrode according to the invention.

FIG. 4 shows the working end of a third working electrode according to the invention in a longitudinal section. As can be seen, also this electrode comprises a cylindrical and towards the working end truncated cone shaped insulator 1, in the center of which there is arranged a central conductor 2. In this case, the central conductor 2 consists of a cylindric metal rod 21 that is press fitted into the insulator 1, which at the working end of the electrode, at which it protrudes out of the insulator 1, comprises a central blind hole bore and, arranged therein, an anti-fatigue shaft bolt 22. The anti-fatigue shaft bolt 22 is fastened with its end facing away from the working end in the central bore by screwing-in in an inner thread at the end thereof and protrudes with its other, working side end, which as well carries an outer thread, out of the central bore of the metal rod 21, where it forms, together with the inner thread of a cap screw nut shaped changing part 4 a first threaded connection 7 according to the claims. In order to preclude a detrimental torsion loading of the anti-fatigue shaft 8 from the outset, there is arranged between the anti-fatigue shaft bolt 22 and the cylindrical metal rod 21, in an area direct adjacent to the first threaded connection 7, a feather key 30, which after the screwing-in of the anti-fatigue shaft bolt 22 into the cylindrical metal rod 21 has been installed by pushing it in oppositely arranged feather key grooves 31, 32 in the thread of the anti-fatigue shaft bolt 22 and in the wall of the central blind hole bore. The changing part 4 in this case is fastened to the central conductor 2 by screwing it onto the threaded end of the anti-fatigue shaft bolt 22, whereat the front face 5 of the changing part 4 that faces away from the from the working end, which end face forms a contact area 5 according to the claims, under a compressive prestress generated trough an elastic elongation of the anti-fatigue shaft bolt 22 axially abuts against the front face 6 of the cylindrical metal rod 21, which front face constitutes a stop area 6 according to the claims. As has been indicated earlier, in the present case the changing part 4 is designed similar to a cap screw nut, by comprising a hexagonal area with three pairs of in each case parallel surfaces 12 for the interaction with a screw wrench and a cap 3 with the shape of a rotation paraboloid, protruding from said area, which cap constitutes the electrode tip 3 according to the claims. In case this tip 3 is worn out or a different electrode material is desired, this changing part 4 can be disassembled without difficulty with a screw wrench and be replaced by a new or different one. For ensuring the desired compressive prestress between the contact area 5 and the stop area 6, the newly assembled changing part 4 is advantageously tightened with a specific torque by means of a torque wrench.

Figure 5:
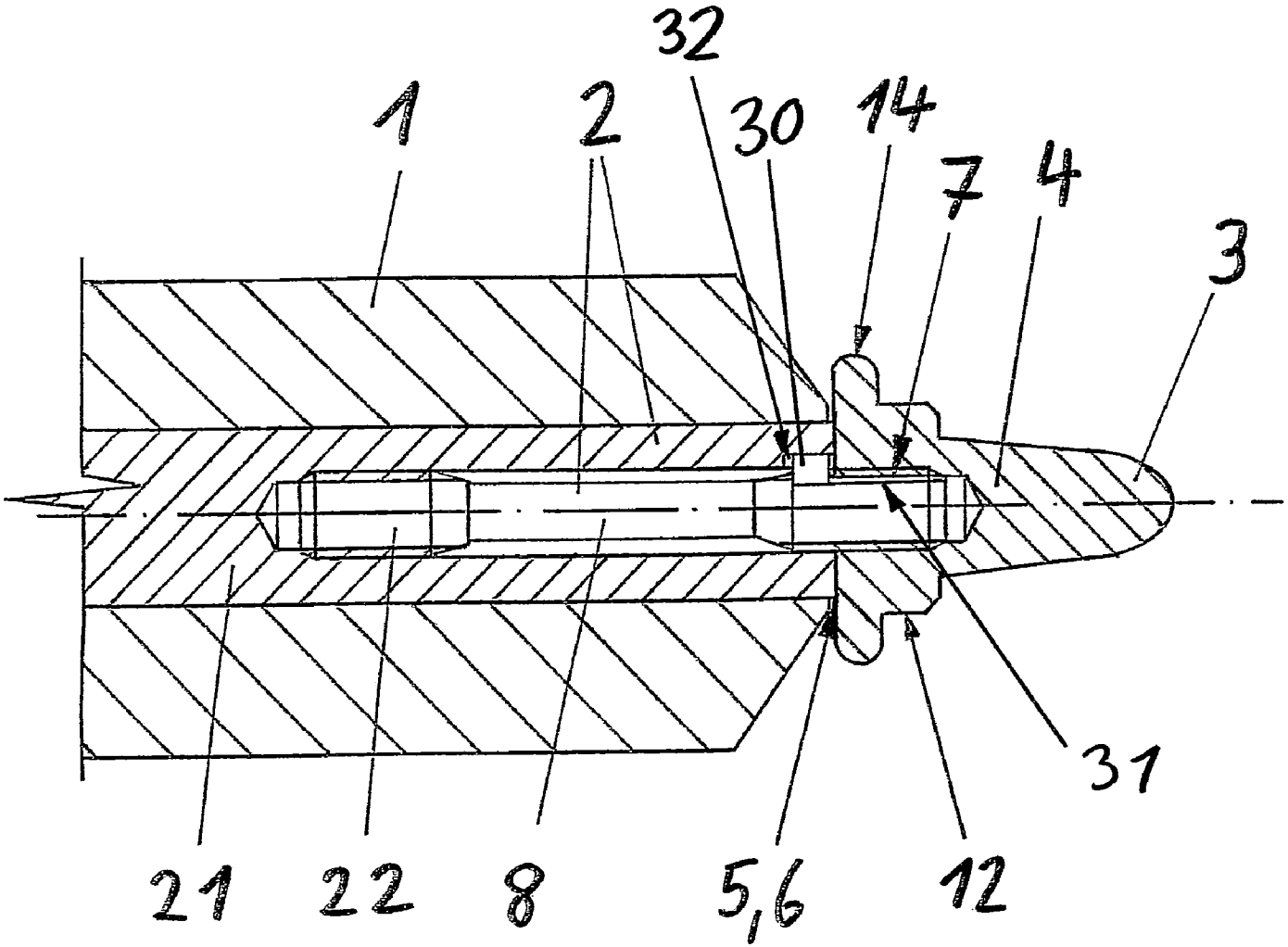
FIG. 5 a longitudinal section through the working end of a fourth working electrode according to the invention.

FIG. 5 shows the working end of a fourth working electrode according to the invention in a longitudinal section, which substantially differs from the working electrode shown in FIG. 4 in that the contact area 5 of the changing part 4 ends in a circumferential radial bead 14, which serves as field relief in the transition area between the insulator 1 and the central conductor 2.

Figure 6:
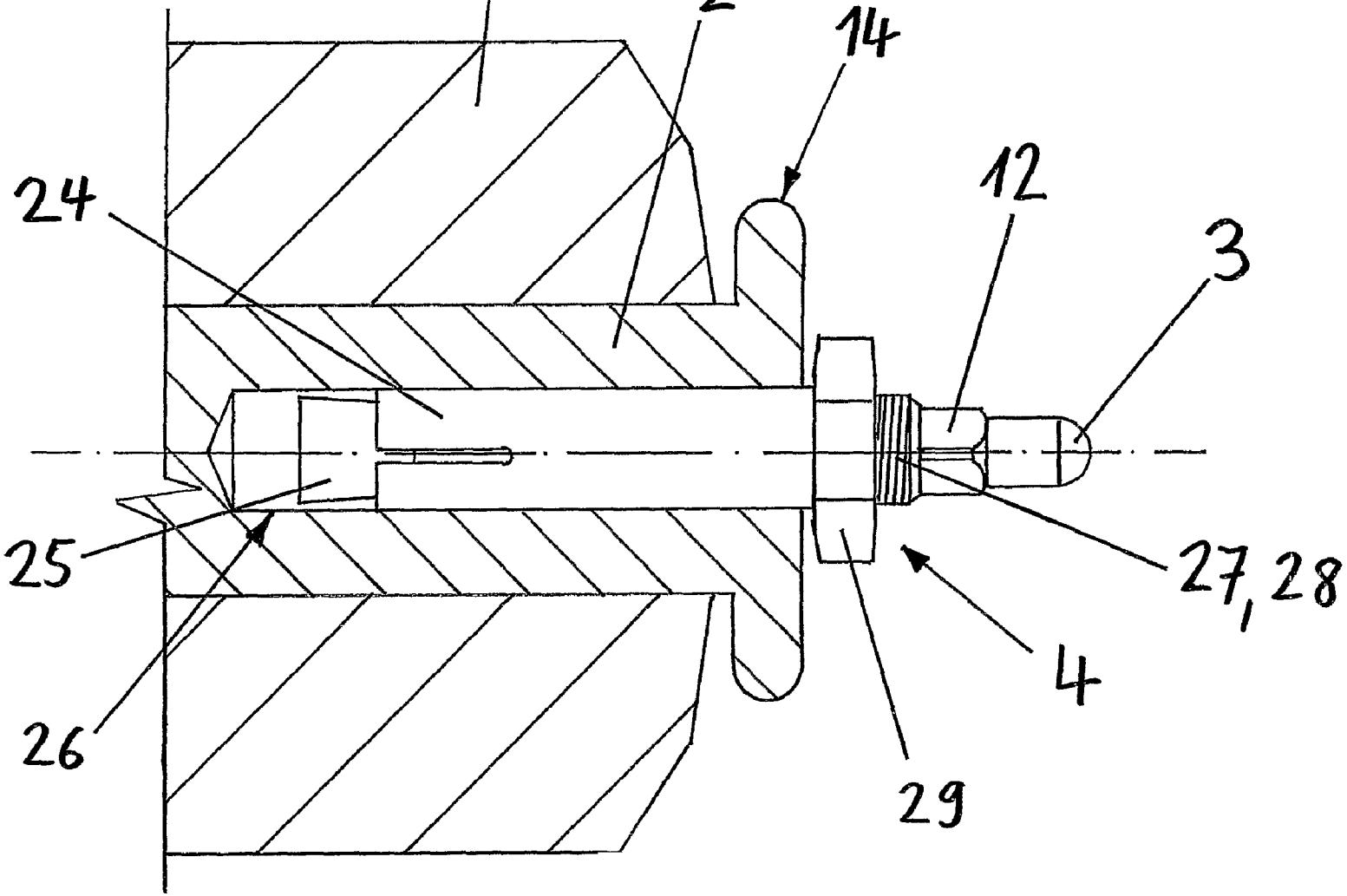
FIG. 6 a longitudinal section through the working end of a fifth working electrode according to the invention.

FIG. 6 shows the working end of a fifth working electrode according to the invention in a longitudinal section. As can be seen, the electrode comprises a cylindrical and towards the working end stepwise truncated cone shaped insulator 1 made of synthetic material, with a central conductor 2 of stainless steel arranged in its center, which is press fitted into the insulator 1. The central conductor 2 comprises at its working end sided face a central cylindrical blind hole bore, which towards the working end, at which the central conductor 2 protrudes out of the insulator 1 under formation of a circumferential, radial bead 14, is opened. Arranged in the central bore of the central conductor 2 is a changing part 4 according to the claims, comprising a cylindrical, at one end slotted expansion sleeve 24 (not shown in section), which by means of a truncated cone shaped spacing body 25 is radially expanded at its slotted end in such a manner that in the area of this end it is radially pressed against the wall 26 of the blind hole bore and thereby is clamped inside the blind hole bore in an axially non-displaceable manner. The spacing body 25 is formed in one piece design together with a driving member 27 for the axial displacement of same in the expansion sleeve in order to effectuate the radial expanding of the expansion sleeve, which driving member at its end facing away from the spacing body 25 protrudes out of the expansion sleeve 24 and at this end ends in an electrode tip 3 having the shape of a spherical calotte. Between the electrode tip 3 and the spacing body 25 the driving member 27 comprises an outer thread 28, on which there is arranged an abutment member 29 (not shown in section) with a respective inner thread, which is designed as a hexagonal screw nut. The abutment member 29 axially rests on the expansion sleeve 24 (not on the interior conductor 2), so that a rotation of same relative to the driving member 27 can cause an axial movement of the spacing body 25 that is connected with the driving member 27 in direction towards the electrode tip 3, which in turn leads to an increasing expanding of the expansion sleeve 24 and to an increase of the clamping forces between the wall 26 of the blind hole bore and the expansion sleeve 24, respectively. In order to achieve an as soft as possible resilience characteristic for the provision of the axial tensile forces of the driving member 27 which ultimately effectuate the clamping forces, the driving member 27 in the area between the spacing body 25 and the outer thread 28 is designed as an anti-fatigue shaft (not visible in the figure). In order to disburden the anti-fatigue shaft of the driving member 27, during tightening of the screw nut 29 for the purpose of expanding and clamping of the expansion sleeve 24 and during untightening of the screw nut 29 for the purpose of removal of the changing part 4, from detrimental torsional forces, the driving member 27 comprises in the area between the electrode tip 3 and the outer thread 28 four in each case by 90° at the circumference displaced surfaces 12, which can be engaged with a flat spanner for securing the driving member 27 against a turning during tightening and untightening, respectively, of the screw nut 29.

Figure 7:
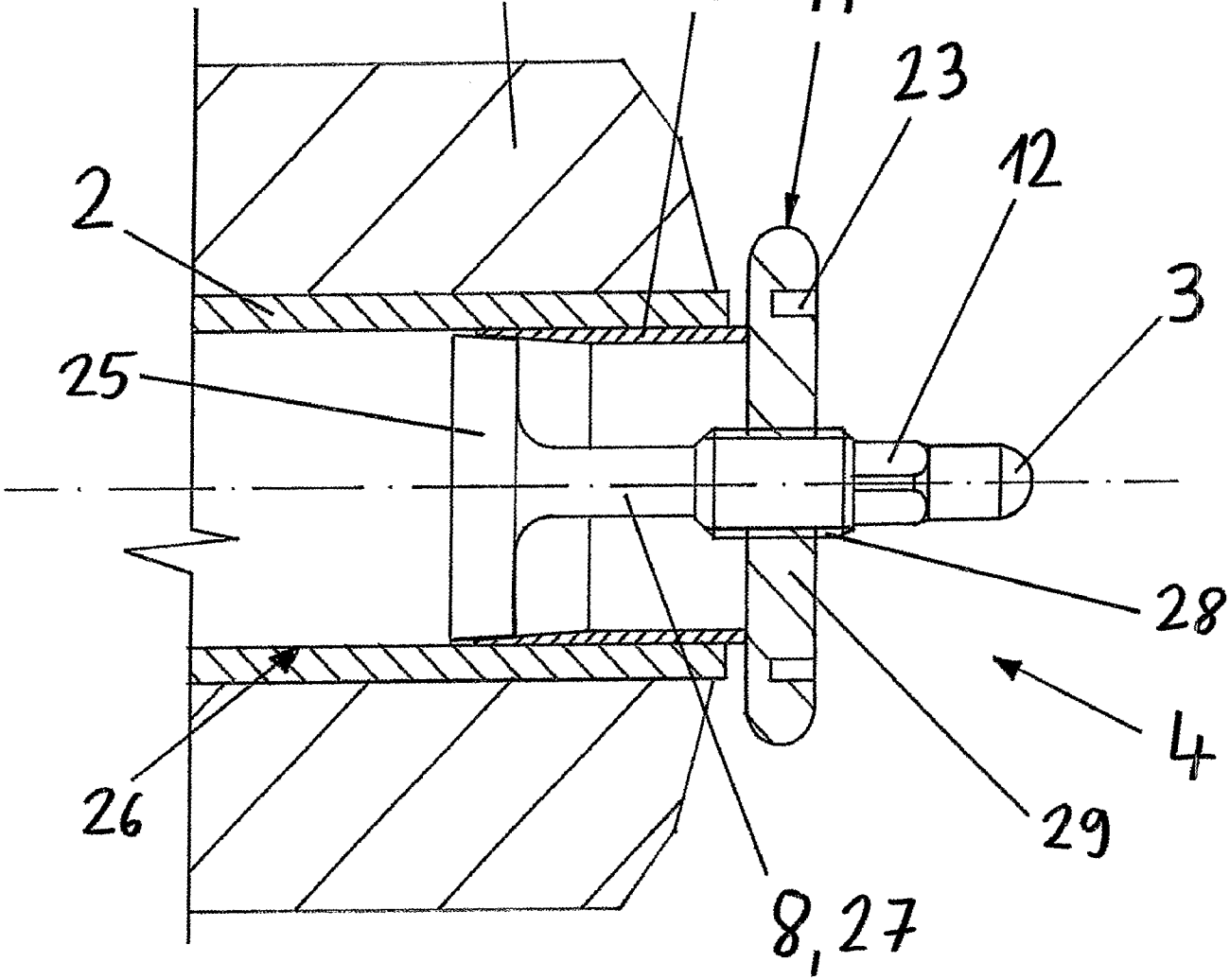
FIG. 7 a longitudinal section through the working end of a sixth working electrode according to the invention.

FIG. 7 shows the working end of a sixth working electrode according to the invention in a longitudinal section, which from its configuration substantially equals the before discussed working electrode. In contrast to the embodiment shown in FIG. 6, in the present case the inner conductor 2 is designed as pure cylindrical sleeve without radial bead and the abutment member 29 as a washer like screw nut with frontal holes having four frontal holes 23 and rounded circumferential edges, which here form the radial bead 14 of the field relief. Furthermore it is eye-catching that the expansion sleeve 24 in this embodiment is shorter and considerably larger in circumference, the spacing body 25 is rather plate shaped in design and the anti-fatigue shaft 8 that is visible here of the driving member 27 is designed shorter than in the example of FIG. 6. The insulator 1, the electrode tip 3, the surfaces 12 and the outer thread 28 of the driving member 27 are however designed identically.

Figure 8:
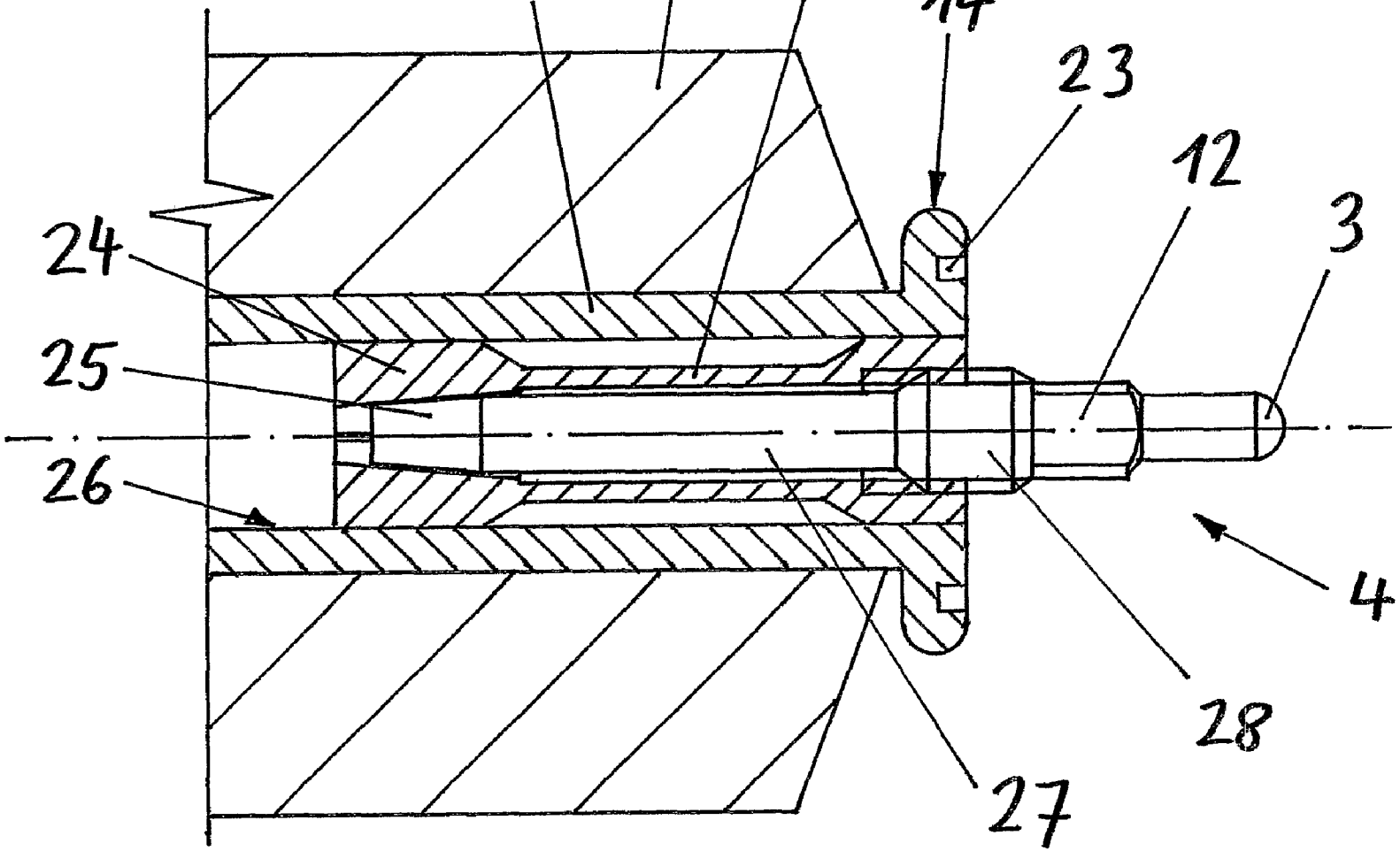
FIG. 8 a longitudinal section through the working end of a seventh working electrode according to the invention.

FIG. 8 shows the working end of a seventh working electrode according to the invention in a longitudinal section. As can be seen, also here the working electrode comprises a cylindrical and towards the working end truncated cone shaped insulator 1, in the center of which there is arranged a central conductor 2. The central conductor 2, at its working end sided front face, comprises a central cylindrical bore, which is opened towards the working end, at which end the central conductor 2 under formation of a circumferential radial bead 14 protrudes out of the insulator 1. The radial bead 14 is equipped with frontal holes 23 for engagement of a face spanner. Arranged in the central bore of the central conductor 2 is a changing part 4 according to the invention, which in the present case comprises an expansion sleeve 24 and a conical spacing body 25 for radially expanding the expansion sleeve 24 through axial displacement relative to same. The spacing body 25 is connected through one piece design with a driving member 27 for displacement of the spacing body 25 in the expansion sleeve 24, which at its end facing away from the spacing body protrudes out of the expansion sleeve 24 and at this end is designed as electrode tip 3 with the shape of a spherical calotte. Between the electrode tip 3 and the spacing body 25 the driving member 27 furthermore comprises an outer thread 28, which is screwed into a respective inner thread at the working side end of the expansion sleeve 24. This area of the expansion sleeve 24 forms an abutment member according to the claims. Spacing body 25, driving member 27, outer thread 28 and electrode tip 3 are here formed from a screwing-in part of one piece design, which furthermore possesses surfaces 12 for interaction with a screwing-in tool and screwing-out tool, respectively, and upon a screwing-in into the expansion sleeve 24 automatically effectuates an expanding and a respective clamping of said sleeve in the bore in the central conductor 2. In order to avoid an introduction of torsional forces into the contact area between the central conductor 2 and the insulator 1, the central conductor 2 during the screwing-in and screwing-out of this screwing-in part is advantageously secured against turning by means of a face spanner. As can further be seen, the expansion sleeve 24 in the area between the inner thread, which interacts with the outer thread 28 of the driving member 27, and the area where it is radially expanded by the spacing body 25, comprises an area 9 which has a significantly reduced cross-section, which area constitutes an anti-fatigue sleeve 9 with a length of about four times the diameter of the inner thread.

While in the present application preferred embodiments of the invention are described, it is to be distinctly understood that the invention is not limited thereto and may be otherwise variously embodied within the scope of the following claims.

The invention claimed is:

1. Working electrode for an electrodynamic fragmenting installation, comprising an insulator, a central conductor disposed in the insulator, the central conductor having a working end, at which there is arranged an electrode tip formed by an exchangeable changing part, wherein the changing part in axial direction under compressive prestress adjoins, with a contact area, a stop area at the working end of the central conductor and at its end facing away from the electrode tip is screwed together, by means of a first threaded connection, with the central conductor, wherein the changing part between the first threaded connection and the contact area comprises an elongation area and/or the central conductor between the first threaded connection and the stop area comprises an elongation area, the elongation area being under tensile prestress thereby generating the compressive prestress between the contact area and the stop area.

2. Working electrode according to claim 1 wherein the changing part between the first threaded connection and the contact area comprises an elongation area, wherein this elongation area is designed as anti-fatigue shaft, which forms at one end the outer thread of the first threaded connection.

3. Working electrode according to claim 1, wherein the changing part between the first threaded connection and the contact area comprises an elongation area, wherein this elongation area is designed as anti-fatigue sleeve, which forms at one end the outer thread of the first threaded connection.

4. Working electrode according to claim 1, wherein the central conductor between the first threaded connection and the stop area comprises an elongation area, wherein this elongation area is designed as anti-fatigue sleeve, which at one end forms the inner thread of the first threaded connection.

5. Working electrode according to claim 1, wherein the central conductor between the first threaded connection and the stop area comprises an elongation area wherein this elongation area is designed as an anti fatigue sleeve which at one end forms the inner thread of the first threaded connection.

6. Working electrode according to claim 1, wherein the changing part is of one-piece design.

7. Working electrode claim 1, wherein the changing part is formed by several parts.

8. Working electrode according to claim 7 wherein the contact area of the changing part is formed by a stop member, which forms together with another part of the changing part, which part forms one mating half of the first threaded connection and is formed as one piece together with the electrode tip, a second threaded connection.

9. Working electrode according to claim 8, wherein the stop member is designed as screw nut, as hexagonal nut or as screw nut with frontal holes.

10. Working electrode claim 1, wherein the changing part between the electrode tip and the contact area comprises an area having a cross-section which is not rotationally symmetrical, comprises two parallel surfaces for the positive interaction with a screwing tool.

11. Working electrode claim 1, wherein the changing part in an area adjacent to its contact area at its outer circumference comprises a circumferential, radial bead.

12. Working electrode according to claim 9, wherein the screw nut at its end facing the central conductor comprises at its outer circumference a circumferential, radial bead.

13. Working electrode according to claim 1, wherein between the changing part and the central conductor there is arranged a gasket, to prevent process fluid from entering into an area formed between them, which area serves for fastening the changing part at the central conductor.

14. Working electrode according to claim 1, wherein the central conductor in the area where it protrudes at the working end side out of the insulator at its outer circumference comprises a circumferential, radial bead.

15. Working electrode according to claim 1, wherein the central conductor in the area where it protrudes at the working end side out of the insulator comprises an area having a cross-section which is not rotationally symmetrical.

16. Working electrode according to claim 1, wherein the central conductor at its working end sided face comprises at least two frontal holes, for the positive interaction with a face spanner.

17. Working electrode according to claim 1, wherein the electrode tip has the shape of a spherical calotte or of a rotation paraboloid.

18. Changing part for a working electrode according to claim 1, comprising an elongate, electrically conductive base body, which carries at its first end a first outer thread and at its other end ends in an electrode tip, wherein between the electrode tip and the first outer thread there is arranged a second outer thread, for engagement with a respective inner thread of a stop member, and wherein the base body between the electrode tip and the second outer thread comprises a cross-section that is not rotationally symmetrical, comprises two parallel surfaces for the positive interaction with a screwing tool, and between the first outer thread and the second outer thread comprises an anti-fatigue shaft, which has a length of at least two times the diameter of the first outer thread.

19. Changing part according to claim 18 further comprising a stop member arranged on the second outer thread, which comprises at least two parallel surfaces for the positive interaction with a flat spanner.

20. Changing part for a working electrode according to claim 1, comprising an elongate, electrically conductive base body, which carries at one end an inner thread and at its other end ends in an electrode tip, wherein between the electrode tip and the inner thread there is arranged a stop shoulder, for axial abutment to a stop surface at the working end of a central conductor of the working electrode receiving the changing part, wherein the base body between the stop shoulder and the electrode tip comprises an area having a cross-section that is not rotationally symmetrical, comprises at least two parallel surfaces for the positive interaction with a screwing tool, with a flat spanner, and between the inner thread and the stop shoulder is designed as an anti-fatigue sleeve over a length of at least two times the diameter of the first inner thread.

21. Changing part according to claim 20, characterized in that it is of one-piece design.

22. Changing part according to claim 20, characterized in that the stop shoulder is formed of a circumferential radial bead of the changing part.

23. Changing part according to one of the claims 21 to 22, wherein the driving member between the spacing body and the outer thread comprises an elongation area which is designed as anti-fatigue shaft or as anti-fatigue sleeve, with a length of at least two times the diameter of the outer thread.

24. Use of the working electrode according to claim 1 for the electrodynamic fragmentation of poorly conductive material.

25. Working electrode according to claim 1 wherein the elongation area is of a length of at least two times the diameter of the first threaded connection.

26. Working electrode for an electrodynamic fragmenting installation, comprising an insulator, a central conductor disposed in the insulator, the central conductor having a working end, a which there is arranged an electrode tip formed by an exchangeable changing part, wherein the changing part by clamping in a non-positive manner is fastened in a frontal opening in the working end of the central conductor and comprises an expansion sleeve and a spacing body disposed in the expansion sleeve, the spacing body radially expanding the expansion sleeve, by means of which the expansion sleeve is radially pressed against a wall of the frontal opening of the central conductor for effecting the clamping.

27. Working electrode according to claim 26, wherein the spacing body has an conical or pyramidal section for radially expanding the expansion sleeve and wherein the spacing body, through one-piece design, is connected with a driving member for axially displacing the spacing body in order to expand the expansion sleeve, which protrudes out of the frontal opening and at its end facing away from the spacing body forms an electrode tip.

28. Working electrode according to claim 27, wherein the driving member between the electrode tip and the spacing body comprises an outer thread for generating an axial displacing force.

29. Working electrode according to claim 28, wherein the spacing body is designed in such a manner that an axial displacement thereof in direction towards the working end of the central conductor effectuates a radial expanding of the expansion sleeve and wherein the outer thread of the driving member (27) interacts with a respective inner thread of a screw nut type abutment member, which axially rests on the expansion sleeve.

30. Working electrode according to claim 29, wherein the screw nut type abutment member is designed as screw nut with at least two frontal holes which forms at its outer circumference a circumferential, radial bead.

31. Working electrode according to one of the claims 29 to 30, wherein the driving member between the spacing body and the outer thread comprises an elongation area which is designed as anti-fatigue shaft or as anti-fatigue sleeve, in particular with a length of at least two times the diameter of the outer thread.

32. Working electrode according to claim 27, wherein the spacing body is designed in such a manner that an axial displacement thereof in a direction showing away from the working end of the central conductor effectuates a radial expansion of the expansion sleeve and wherein the outer thread of the driving member interacts with a respective inner thread of an abutment member, which is connected with the expansion sleeve for transferring axial tensile forces between the abutment member and the expansion sleeve and, which is formed as one piece together with the expansion sleeve.

33. Working electrode according to claim 32, wherein the expansion sleeve in the area between the abutment member and the area, in which it is radially expanded by the spacing body, comprises an elongation area with a length of at least two times the diameter of the inner thread of the abutment member.

34. Changing part for a working electrode according to one of the claims 32 to 33, comprising an expansion sleeve and an conical or pyramidal spacing body for radially expanding the expansion sleeve through axial displacement of said spacing body relative to the expansion sleeve, wherein the spacing body through material connection, is connected with a driving member for displacing the spacing body in the expansion sleeve, which driving member protrudes at its end facing away from the spacing body out of the expansion sleeve and at this end forms an electrode tip which has the shape of a spherical calotte or of a rotation paraboloid, and wherein the driving member between the electrode tip and the spacing body comprises an outer thread which interacts with a respective inner thread of an abutment member which is connected with the expansion sleeve for the transmission of axial tensile forces between the abutment member and the expansion sleeve, so that upon rotation of the driving member relative to the abutment member an axial movement of the spacing body in a direction facing away from the electrode tip can be effected, under an increasing expanding of the expansion sleeve.

35. Changing part according to claim 34, wherein the abutment member is formed as one piece together with the expansion sleeve.

36. Changing part according to claim 34, wherein the expansion sleeve in the area between the abutment member and the area where it is radially expanded by the spacing body comprises an elongation area with a length of at least two times the diameter of the inner thread of the abutment member.

37. Working electrode according to claim 26, wherein the driving member between the electrode tip and the spacing body comprises an area having a cross-section which is not rotationally symmetrical, comprises two parallel surfaces for the positive interaction with a tool for turning same or securing same against turning.

38. Changing part for a working electrode according to claim 26, comprising an expansion sleeve and an conical or pyramidal spacing body for radially expanding the expansion sleeve upon axial displacement of said spacing body relative to the expansion sleeve, wherein the spacing body through material connection, is connected with a driving member for displacing the spacing body in the expansion sleeve, which driving member protrudes at its end facing away from the spacing body out of the expansion sleeve and at this end forms an electrode tip (3) which has the shape of a spherical calotte or of a rotation paraboloid, and wherein the driving member between the electrode tip and the spacing body comprises an outer thread (28) and arranged on said outer thread an screw nut type abutment member, which axially rests on the expansion sleeve so that upon rotation thereof relative to the driving member an axial movement of the spacing body in direction towards the electrode tip can be effected, under an increasing expansion of the expansion sleeve.

39. Changing part according to claim 38, wherein the abutment member is designed as screw nut with frontal holes, with at least two frontal holes, which forms at its outer circumference a circumferential, radial bead.

40. Working electrode according to claim 26 wherein the spacing body includes an anti-fatigue shaft extending from where the expansion sleeve is clamped to the wall of the central conductor to a location adjacent to an opposite end of the expansion sleeve toward the electrode tip, the anti-fatigue shaft being under a tensile stress.

41. Working electrode for an electrodynamic fragmenting installation, comprising an insulator, a central conductor disposed in the insulator and defining a working end and a central bore, an exchangeable changing part partially disposed in the central bore of the central conductor and defining an electrode tip outside of the central conductor, wherein the changing part includes a first part that is fixed to an interior wall of the central bore, a second part that is disposed outside of the central bore proximate to the electrode tip, and an elongation area extending between the first and second parts, the elongation area being under a tensile stress.

42. Working electrode according to claim 41 wherein the second part of the changing part includes a contact area that adjoins a stop area of at the working end of the central conductor under axial compressive prestress, and wherein the first part of the changing part is screwed to the central conductor at a first threaded connection such that the elongation area of the changing part extends from the first threaded connection to the contact area.

43. Working electrode according to claim 41 wherein the changing part comprises a expansion sleeve, a spacing body including a driving member at least partially disposed in the expansion sleeve, and an abutment member disposed on the driving member of the spacing body, the abutment member axially abutting the expansion sleeve at the second part of the changing part to cause the spacing body to radially expand the expansion sleeve against a wall of the central bore of the conductor at the first part of the changing part, thereby fastening the changing part in the central bore.

* * * * *

UNITED STATES PATENT AND TRADEMARK OFFICE

CERTIFICATE OF CORRECTION

PATENT NO. : 8,125,129 B2
APPLICATION NO. : 12/278750
DATED : February 28, 2012
INVENTOR(S) : Maurer et al.

It is certified that error appears in the above-identified patent and that said Letters Patent is hereby corrected as shown below:

In the Claims

In Column 13, Line 35, in Claim 7, delete “electrode” and insert -- electrode according to --, therefor.

In Column 13, Line 46, in Claim 10, delete “electrode” and insert -- electrode according to --, therefor.

In Column 13, Line 51, in Claim 11, delete “electrode” and insert -- electrode according to --, therefor.

In Column 14, Line 61, in Claim 26, delete “a which” and insert -- at which --, therefor.

In Column 15, Line 21, in Claim 29, delete “member (27)” and insert -- member --, therefor.

In Column 16, Line 28, in Claim 38, delete “electrode tip (3)” and insert -- electrode tip --, therefor.

In Column 16, Line 31, in Claim 38, delete “outer thread (28)” and insert -- outer thread --, therefor.

Signed and Sealed this
Ninth Day of September, 2014

Michelle K. Lee

Michelle K. Lee
*Deputy Director of the United States Patent and Trademark Office*